US007265492B2

(12) United States Patent
Kim et al.

(10) Patent No.: US 7,265,492 B2
(45) Date of Patent: Sep. 4, 2007

(54) PLASMA DISPLAY PANEL WITH DISCHARGE CELLS HAVING CURVED CONCAVE-SHAPED WALLS

(75) Inventors: Young-Mo Kim, Suwon-si (KR); Sang-Hun Jang, Yongin-si (KR); Seung-Hyun Son, Hwaseong-si (KR); Hidekazu Hatanaka, Seongnam-si (KR); Seong-Eui Lee, Seongnam-si (KR); Xiaoqing Zeng, Yongin-si (KR); Gi-Young Kim, Chungju-si (KR); Hyoung-Bin Park, Seongnam-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 96 days.

(21) Appl. No.: 10/902,114

(22) Filed: Jul. 30, 2004

(65) Prior Publication Data

US 2005/0099126 A1 May 12, 2005

(30) Foreign Application Priority Data

Nov. 11, 2003 (KR) ..... 10-2003-0079601

(51) Int. Cl.
*H01J 17/49* (2006.01)

(52) U.S. Cl. ..... 313/586; 313/583; 313/584; 313/582; 313/585

(58) Field of Classification Search ..... 313/586
See application file for complete search history.

(56) References Cited

U.S. PATENT DOCUMENTS 5,541,618 A 7/1996 Shinoda ..... 345/60

(Continued)

FOREIGN PATENT DOCUMENTS

JP 02-148645 6/1990

(Continued)

OTHER PUBLICATIONS

"*Final Draft International Standard*", Project No. 47C/61998-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Sikha Roy
*Assistant Examiner*—Natalie K. Walford
(74) *Attorney, Agent, or Firm*—Robert E. Bushnell, Esq.

(57) ABSTRACT

A plasma display panel is provided. The plasma display panel includes front and rear substrates facing each other to form a discharge space therebetween, a plurality of address electrodes provided in stripes on an upper surface of the rear substrate, a first dielectric layer provided to cover the address electrodes on the upper surface of the rear substrate, and partitions provided on a upper surface of the first dielectric layer to partition the discharge space. On a lower surface of the front substrate are a plurality of second dielectric layers extending in a direction perpendicular to the address electrodes, each of the second dielectric layers protruding from a lower surface of the front substrate, both sides of each of the second dielectric layers being concavely curved, first and second sustaining electrodes provided to be slanted to face each other on both sides of each of the second dielectric layers, and a third dielectric layer provided on a lower surface of the second dielectric layers to cover the first and second sustaining electrodes.

3 Claims, 4 Drawing Sheets

U.S. PATENT DOCUMENTS

| | | | | |
|---|---|---|---|---|
| 5,661,500 | A | 8/1997 | Shinoda et al. | 313/585 |
| 5,663,741 | A | 9/1997 | Kanazawa | 345/66 |
| 5,674,553 | A | 10/1997 | Sinoda et al. | 427/68 |
| 5,724,054 | A | 3/1998 | Shinoda | 345/60 |
| 5,786,794 | A | 7/1998 | Kishi et al. | 345/60 |
| 5,952,782 | A | 9/1999 | Nanto | 313/584 |
| 6,339,292 | B1 * | 1/2002 | Ha | 313/582 |
| 6,346,775 | B1 * | 2/2002 | Lee et al. | 313/495 |
| 6,525,470 | B1 * | 2/2003 | Amemiya | 313/586 |
| 6,548,957 | B1 * | 4/2003 | Kim et al. | 313/585 |
| 6,630,916 | B1 | 10/2003 | Shinoda | 345/60 |
| 6,707,436 | B2 | 3/2004 | Setoguchi et al. | 345/60 |
| 6,768,262 | B2 * | 7/2004 | Ahn et al. | 313/586 |
| 6,870,316 | B2 * | 3/2005 | Sano et al. | 313/583 |
| 2003/0052604 | A1 * | 3/2003 | Amemiya | 313/582 |
| 2005/0082981 | A1 * | 4/2005 | Jang et al. | 313/587 |

FOREIGN PATENT DOCUMENTS

| | | |
|---|---|---|
| JP | 2845183 | 10/1998 |
| JP | 2917279 | 4/1999 |
| JP | 2001-043804 | 2/2001 |
| JP | 2001-325888 | 11/2001 |
| JP | 2004146171 A * | 5/2004 |

* cited by examiner

PLASMA DISPLAY PANEL WITH DISCHARGE CELLS HAVING CURVED CONCAVE-SHAPED WALLS

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on Nov. 11, 2003 and there duly assigned Serial No. 2003-79601.

BACKGROUND OF THE INVENTION

1. Field of the Invention

The present invention relates to a plasma display panel (or PDP), and more particularly, to a plasma display panel having an enhanced structure capable of efficiently generating a plasma discharge by forming a pair of sustaining electrodes to be slanted to face each other on a front substrate.

2. Description of the Related Art

A plasma display panel using an electrical discharge to form an image has such good display performance in brightness and viewing angle that the plasma display panel is becoming popular. In the plasma display panel, a gas discharge is generated in a gas filled between electrodes by applying DC or AC voltage on to the electrodes, and ultraviolet rays of light involved in the gas discharge excite a fluorescent material to emit visible rays of light.

The plasma display panel is classified into DC and AC plasma display panels depending on types of discharge. In the DC plasma display panel, all electrodes are exposed in a discharge space, and a discharge is generated by electrical charges directly moving between electrodes. On the other hand, in the AC plasma display panel, at least one electrode is covered with a dielectric layer, and a discharge is generated by wall charges instead of the electrical charges directly moving between the electrodes.

In addition, the plasma display panel is classified into facing and surface discharge plasma display panels depending on the arrangement of the electrodes. In the facing discharge plasma display panel, two sustaining electrodes provided on front and rear substrates, respectively, face each other, and a discharge is generated in a direction perpendicular to the substrates. On the other hand, in the surface discharge plasma display panel, a pair of sustaining electrodes are provided on the same substrate, and a discharge is generated on a surface of the substrate.

Although it has high luminous efficiency, the facing discharge plasma display panel has a disadvantage in that its fluorescent layer can be easily deteriorated due to plasma particles. Therefore, the surface discharge plasma display panel has been mainly used. Therefore, what is needed is an improved design for a surface discharge plasma display panel.

SUMMARY OF THE INVENTION

It is therefore an object of the present invention to provide an improved design for a plasma display panel.

It is also an object of the present invention to provide a design for a plasma display panel that improves luminous efficiency and improves brightness.

It is also an object of the present invention to provide a design for a plasma display panel that requires less address discharge voltage during the address interval.

It is still an object of the present invention to provide a plasma display panel that provides improved bright room contrast.

It is yet another object of the present invention to provide a plasma display panel that lessens the amount of visible rays that are screened between formation in the discharge cell and when the visible radiation emerges from the front substrate of the display.

It is further an object of the present invention to provide a plasma display panel that reduces the magnitude of the discharge voltage.

These and other objects can be achieved by a plasma display panel that has a pair of sustaining electrodes slanted to face each other on a front substrate. The rear substrate having address electrodes formed thereon in a stripe pattern and covered by a first dielectric layer. The plasma display panel also has a plurality of second dielectric layers extending in a direction perpendicular to address electrodes on the rear substrate, each of the second dielectric layers protruding from a lower surface of the front substrate, both sides of each of the second dielectric layers being concavely curved, first and second sustaining electrodes provided to be slanted to face each other on both sides of each of the second dielectric layers, and a third dielectric layer provided on a lower surface of the second dielectric layers to cover the first and second sustaining electrodes.

Preferably, a width of each of the second dielectric layers become gradually narrow downward further away from the front substrate. Preferably, the second dielectric layers be made of a transparent dielectric material or glass. Preferably the second dielectric layers be formed to be integral with the front substrate. Preferably, a trench is arranged to extend in a longitudinal direction of each of the second dielectric layers between the first and second sustaining electrodes. Preferably, a black stripe is formed on a bottom surface of the trench and on both sidewalls of the trench.

Preferably, first and second bus electrodes be provided on lower surfaces of the first and second sustaining electrodes. Preferably, the first and second bus electrodes are provided at edges of the lower surfaces of the first and second sustaining electrodes. Preferably, carbon nano-tube elements are formed at lower portions of the first and second bus electrodes. Preferably, a protective layer is formed on a lower surface of the third dielectric layer. Preferably, partitions are formed at positions opposite to the corresponding second dielectric layers.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
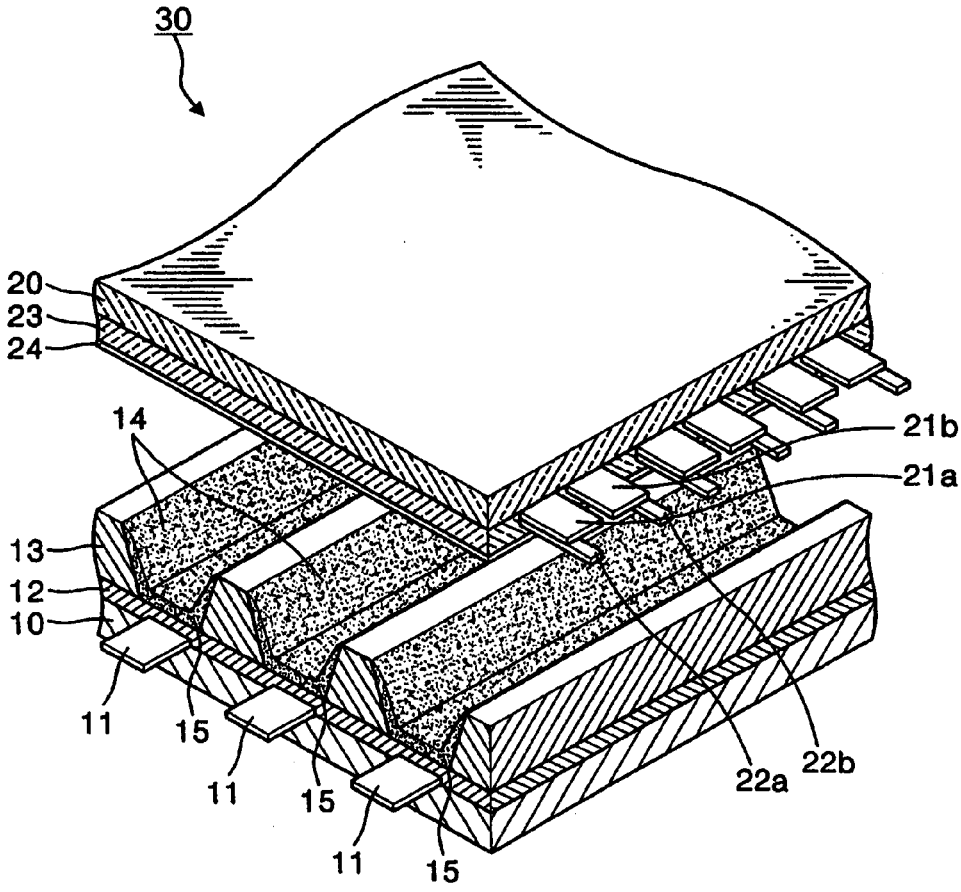
FIG. 1 (PRIOR ART)
FIG. 1 is an exploded perspective view illustrating a surface discharge plasma display panel.
Figure 2:
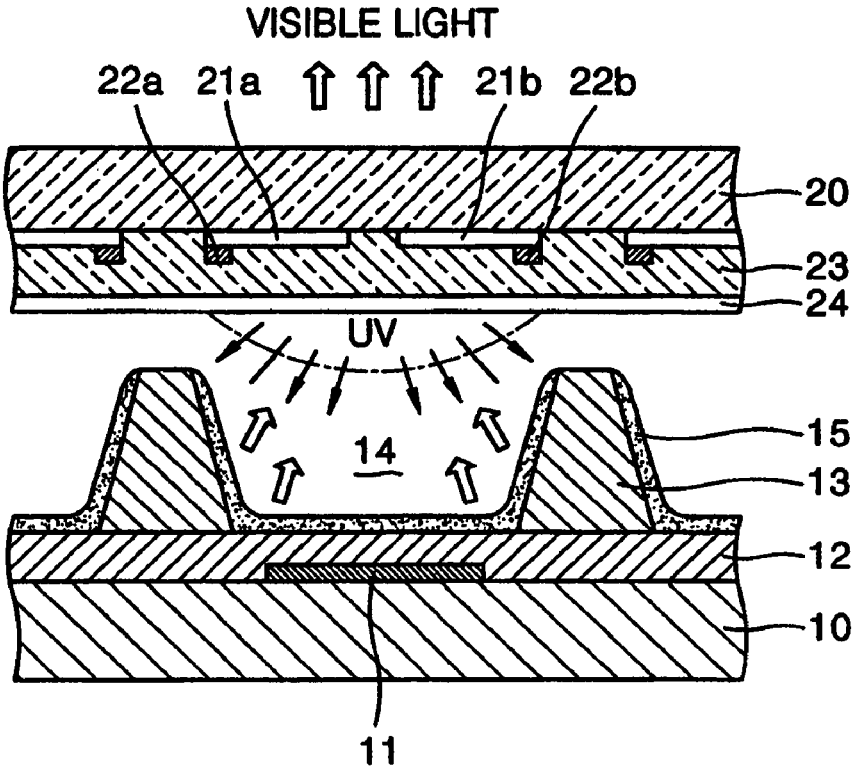
FIG. 2 (PRIOR ART)
FIG. 2 is a cross sectional view of the surface discharge plasma display panel of FIG. 1.

Turning now to the figures, FIG. 1 illustrates a surface discharge plasma display panel 30. FIG. 2 illustrates a cross sectional view of the plasma display panel 30 of FIG. 1 with the rear substrate 10 rotated 90° with respect to the front substrate 20.

Referring to FIGS. 1 and 2, the plasma display panel 30 includes rear and front substrates 10 and 20 facing each other. A plurality of address electrodes 11 are formed in stripes on an upper surface of the rear substrate 10. The address electrodes 11 are embedded in a first dielectric layer 12 made of a white dielectric material. A plurality of partitions 13 are provided at a predetermined interval on an upper surface of the first dielectric layer 12 in order to prevent electrical or optical crosstalk between discharge cells 14. The partitions 13 are preferably essentially orthogonal to the address electrodes 11. Red (R), green (G) and blue (B) fluorescent layers 15 having a predetermined thickness are coated on inner surfaces of respective discharge cells 14 defined by the partitions 13. The discharge cells 14 are filled with a discharge gas which is generally a mixture of Ne and Xe.

The front substrate 20 is a transparent substrate, mainly made of glass, allowing visible rays of light to pass. The front substrate 20 is assembled to the rear substrate 10 with the partitions 13 formed thereon. On a lower surface of the front substrate 20 are provided pairs of sustaining electrodes 21*a* and 21*b* in stripes in a direction perpendicular to the address electrodes 11. The sustaining electrodes 21*a* and 21*b* are mainly made of a transparent, conductive material such as indium tin oxide (ITO) capable of passing the visible rays of light. On lower surfaces of the sustaining electrodes 21*a* and 21*b* are provided bus electrodes 22*a* and 22*b*, made of metal, having narrower widths than the sustaining electrodes 21*a* and 21*b* in order to reduce line resistance thereof. The sustaining electrodes 21*a* and 21*b* and bus electrodes 22*a* and 22*b* are embedded in a second dielectric layer 23 which is a transparent layer. A protective layer 24 is formed on a lower surface of the second dielectric layer 23. The protective layer 24 serves to prevent the second dielectric layer 23 from deteriorating due to sputtered plasma particles and serves to reduce discharge and sustaining voltages by emitting secondary electrons. The protective layer 24 is generally made of MgO.

A driving scheme of the plasma display panel 30 illustrated in FIGS. 1 and 2 is classified into address and sustaining driving schemes or address and sustaining time intervals. In the address driving schemes, an address discharge is generated between the address electrode 11 and one sustaining electrode 21*a*, and at this time, wall charges are formed. On the other hand, in the sustaining driving scheme, a sustaining discharge is generated by a potential difference between the sustaining electrodes 21*a* and 21*b* located at a discharge cell 14 where the wall charges are formed. Ultraviolet rays of light emitted from a discharge gas during the sustaining discharge excite the fluorescent layer 15 in the discharge cell 14 to emit visible rays of light. The visible rays of light passing through the front substrate 20 form an image which can be seen by human eyes.

In the plasma display panel 30 of FIGS. 1 and 2, a distance between the sustaining electrodes 21*a* and 21*b* is wide enough to generate a highly efficient plasma discharge. If the distance between the sustaining electrodes 21*a* and 21*b* is too wide, there a problem that a sustaining discharge voltage increases. In addition, there is another problem that an address discharge voltage must increase in order to accumulate wall charges.

Figure 3:
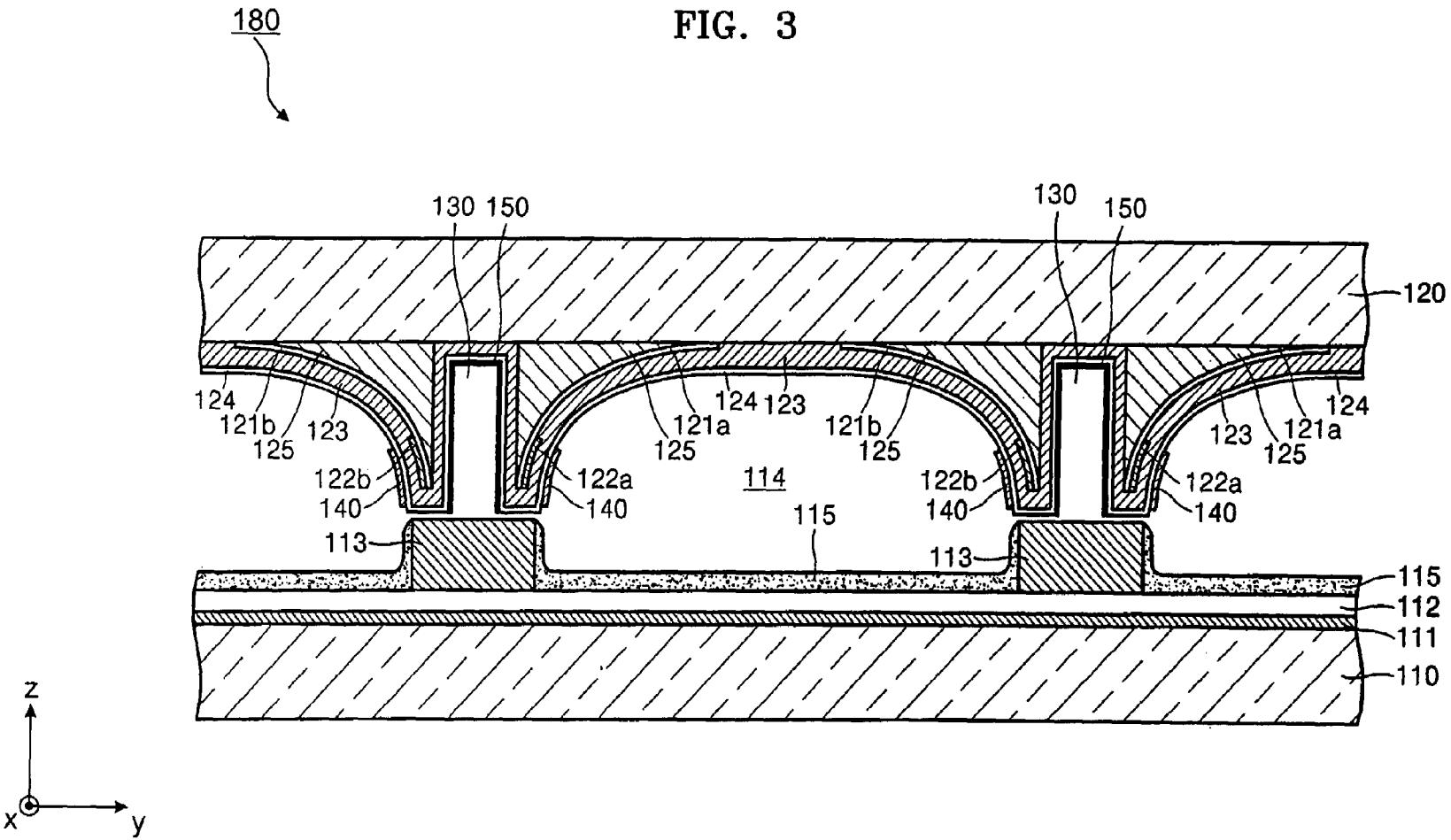
FIG. 3 is an exploded perspective view illustrating a plasma display panel according to the present invention.

Turning now to FIG. 3, FIG. 3 is an exploded perspective view illustrating a plasma display panel 180 according to the present invention. The plasma display panel 180 according to the present invention includes rear and front substrates 110 and 120 facing each other. Between the rear and front substrates 110 and 120 is a discharge space where a plasma discharge is generated.

A plurality of address electrodes 111 are provided in stripes in a +/−y-direction on an upper surface (+z-surface) of the rear substrate 110. Rear substrate 110 is preferably a glass substrate. A first dielectric layer 112 is also provided on the upper surface of the rear substrate 110 to cover the address electrodes 111. The first dielectric layer 112 is formed by depositing a white dielectric material on the upper surface of the rear substrate 110.

A plurality of partitions 113 for partitioning the discharge space into a plurality of discharge cells 114 are provided at a predetermined interval on an upper surface of the first dielectric layer 112. In plasma display panel 180, the partitions 113 are formed in a +/−x-direction and, unlike PDP 30 of FIGS. 1 and 2, the partitions 113 are essentially orthogonal to the address electrodes 111. The partitions 113 have a function of preventing electrical or optical crosstalk between the discharge cells 114. In the present invention, a plurality of second dielectric layers 125 protruding from a lower surface (−z-surface) of the front substrate 120 are provided at positions opposite to the corresponding partitions 113. Each of the partitions 113 are formed to have a lower height than those of the partitions of the plasma display panel 30 of FIGS. 1 and 2. Since the height of each of the partitions 113 is reduced by as much as the protruded length of the corresponding second dielectric layer 125, it is possible to obtain the same size of each of the discharge cells 114 as that of the plasma display panel 30 illustrated in FIGS. 1 and 2. The discharge cells 114 are filled with a discharge gas which is generally a mixture of Ne and Xe. Each of red (R), green (G) and blue (B) fluorescent layers 115 is coated on the upper surface of the first dielectric layer 112 and on the sidewalls of the partitions 113 on an inner surface of the corresponding discharge cell 114.

The front substrate 120 is an optically transparent substrate, preferably made of glass, allowing visible rays of light to pass. The plurality of second dielectric layers 125 are provided and protrude from the lower surface of the front substrate 120 may be formed to be integral with the front substrate 120. The second dielectric layers 125 may be made of an optically transparent dielectric material such as glass or some other transparent materials. The second dielectric layers 125 formed to protrude from the lower surface (−z-side) of the front substrate 120 are formed in a +/−x-direction which is perpendicular to the address electrodes 111 on the rear substrate 110. A width of each second dielectric layer 125 becomes gradually narrower the further downward (i.e., −z-direction) away from front substrate 120. Both sides of each second dielectric layer 125 are concavely curved. As described above, the second dielectric layers 125 are provided to face the corresponding partitions 113. Therefore, spaces between the neighboring second dielectric layers 125 become the discharge cells 114. A trench 130 is further provided to extend in a longitudinal direction (i.e., +/−x-direction) at the center of each second dielectric layer 125. The trench is formed in a +z-direction but the trench extends in the +/−x-direction which is essentially parallel to the partitions 113 and essentially orthogonal to the address electrodes 111.

A black stripe 150 may be formed on an inner surface of the trench 130, that is, on a bottom surface and on both sidewalls of the trench 130. The black stripe 150 has functions of 1) effectively preventing visible rays of light generated in one discharge cell from entering a neighboring discharge cell 114 and 2) preventing external rays of light from an outside of the plasma display panel from entering discharge cells 114. Therefore, it is possible to improve "bright room contrast" of the plasma display panel 180 by forming the black stripe 150 as described above.

A pair of first and second sustaining electrodes 121*a* and 121*b* are provided on both sides of each of the second dielectric layers 125. Like the second dielectric layers 125, the first and the second sustaining electrodes 121*a* and 121*b* are also concavely curved. Since they are provided on both of the concavely-curved sides, the first and second sustaining electrodes 121*a* and 121*b* are slanted to face each other on the front substrate 120. The first and second sustaining electrodes 121*a* and 121*b* are preferably made of ITO, a transparent material allowing visible rays of light to pass. By forming the first and second sustaining electrodes 121*a* and 121*b* to be slanted to face each other, it is possible to reduce a discharge distance and improve luminous efficiency.

On the other hand, since ITO of the first and second sustaining electrodes 121*a* and 121*b* has a high resistance for a conductor, first and second bus electrodes 122*a* and 122*b* made of a highly conductive metal are provided at edges of the lower surfaces of the first and second sustaining electrodes 121*a* and 121*b* in order to reduce line resistance of the first and second sustaining electrodes. The first and second bus electrodes 122*a* and 122*b* are slanted to face each other on the front substrate 120. Therefore, a facing discharge can be induced in the discharge cell 114. In addition, it is noted that a smaller amount of visible rays are blocked by first and second bus electrodes 122*a* and 122*b* of plasma display panel 180 because of the slanting compared to the blockage of the bus electrodes of the plasma display panel 30 in FIGS. 1 and 2.

A third dielectric layer 123 is further provided to cover the first and second sustaining electrodes 121*a* and 121*b* and the first and second bus electrodes 122*a* and 122*b*. The third dielectric layer 123 is formed by depositing a transparent material with a predetermined thickness on the first and second sustaining electrodes 121*a* and 121*b* and the first and second bus electrodes 122*a* and 122*b*.

A protective layer 124 is then formed a lower surface of the third dielectric layer 123. The protective layer 124 has a function of preventing the third dielectric layer 123 and the first and second sustaining electrodes 121*a* and 121*b* from deteriorating due to sputtering of plasma particles. In addition, the protective layer 124 has a function of reducing discharge and sustaining voltages by emitting secondary electrons. The protective layer 124 may be formed by depositing magnesium oxide (MgO) with a predetermined thickness on the lower surface of the third dielectric layer 123.

Furthermore, carbon nano-tube (CNT) elements 140 may be formed on some portions of a lower surface of the protective layer 124, at a location where the first and second bus electrodes 122*a* and 122*b* are formed. The CNT elements 140 may be also applied on the lower surfaces of the first and second bus electrodes 122*a* and 122*b*. By forming the CNT elements 140 at the lower portions of the first and second bus electrodes 122*a* and 122*b*, it is possible to reduce the discharge voltage involved in an electric field emission and as well as improve the brightness of the plasma display panel 180. In addition, since the CNT elements 140 are slanted with respect to the front substrate 120, CNT elements 140 block less visible light than would otherwise be blocked if they were not slanted.

With the aforementioned arrangement of the plasma display panel 180, the address discharge is generated between the address electrodes 111 and one of the first and second sustaining electrodes 121*a* and 121*b*. During this address discharge or address interval, wall charges are generated on the third dielectric layer 123. Since the first and second bus electrodes 122*a* and 122*b* are located near the address electrodes 111, it is possible to smoothly generate the address discharge.

Figure 4:
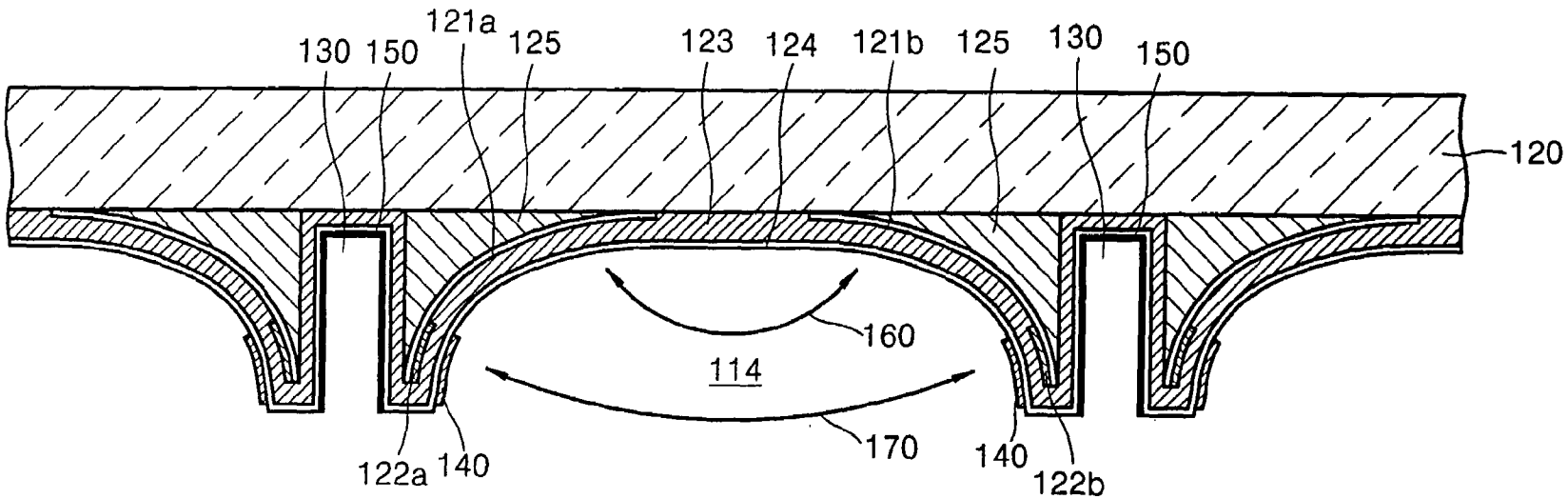
FIG. 4 illustrates a start discharge and a main discharge of the plasma display panel according to the present invention.

Next, the sustaining discharge is generated due to a voltage difference between the first and second sustaining electrodes 121*a* and 121*b* within a single discharge cell 114. Referring to FIG. 4, a start discharge 160 is generated between the neighboring portions of the first and second sustaining electrodes 121*a* and 121*b* in the discharge cell 114. At this time, since the first and second sustaining electrodes 121*a* and 121*b* are provided substantially parallel to the front substrate 120, a surface discharge can be induced. Next, a main discharge 170 is generated between the far-away portions of the first and second sustaining electrodes 121*a* and 121*b*. Since the far-away portions of the first and second sustaining electrodes 121*a* and 121*b* are formed to be substantially perpendicular to the front substrate 120, the facing discharge can be generated. As a result, it is possible to obtain a uniform and a strong plasma discharge.

A plasma display panel 180 of FIGS. 3 and 4 has advantages as follows. Firstly, since second dielectric layers 125 are provided to protrude from a lower surface of a front substrate 120 and since both sides of each second dielectric layer 125 are concavely curved, a facing discharge can be induced during a main discharge cycle of a sustaining discharge. Therefore, it is possible to improve luminous efficiency and improve brightness of a plasma display panel.

Secondly, since bus electrodes 122*a* and 122*b* are located closer to the address electrodes 111 than in the plasma display panel 30 of FIGS. 1 and 2, an address discharge can be smoothly generated. Therefore, it is possible to reduce an address discharge voltage.

Thirdly, since a black stripe 150 is applied on an inner surface of a trench 130 provided in each second dielectric layer 125, it is possible to effectively prevent visible rays of light generated in a discharge cell 114 from entering neighboring discharge cells. In addition, this black stripe 150 serves also to improve bright room contrast of the plasma display panel.

Fourthly, since the bus electrodes 122*a* and 122*b* are slanted to face each other on the front substrate 120, it is possible to further reduce a visible-ray shielding effect caused by the bus electrode than in the non-slanted design of PDP 30 of FIGS. 1 and 2.

Fifthly, since carbon nano-tube (CNT) elements 140 are formed at lower portions of the bus electrodes 122*a* and 122*b*, it is possible to reduce the discharge voltage involved in an electric field emission and to improve brightness of PDP 180.

While the present invention has been particularly shown and described with reference to exemplary embodiments thereof, it will be understood by those skilled in the art that various changes in form and details may be made therein without departing from the spirit and scope of the invention as defined by the appended claims. The exemplary embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. A plasma display panel, comprising:

front and rear substrates facing each other to form a discharge space therebetween;

a plurality of address electrodes arranged in stripes on an upper surface of the rear substrate;

a first dielectric layer arranged to cover the address electrodes on the upper surface of the rear substrate;

partitions arranged on an upper surface of the first dielectric layer to partition the discharge space into a plurality of discharge cells;

a plurality of second dielectric layers extending in a direction perpendicular to the address electrodes, each of the second dielectric layers protruding from a lower surface of the front substrate, each discharge cell being partially bounded by two sides of second dielectric layers, said two sides of the second dielectric layers being concavely curved;

a first and a second sustaining electrodes arranged over the second dielectric layer in each discharge cell to be slanted to face each other;

a third dielectric layer arranged over a lower surface of the second dielectric layers to cover the first and second sustaining electrodes, wherein a trench perforates the second dielectric layers and runs between adjacent ones of said plurality of discharge cells and being arranged in a direction perpendicular to the front substrate; and a black stripe arranged on a bottom surface of the trench.

2. The plasma display panel of claim 1, wherein the black stripe is further arranged on sidewalls of the trench.

3. A plasma display panel, comprising:

a rear substrate;

a plurality of address electrodes arranged in stripes on an upper surface of the rear substrate;

a first dielectric layer arranged to cover the address electrodes on the upper surface of the rear substrate:

a plurality of partitions arranged on an upper surface of the first dielectric layer and formed between discharge cells;

a front substrate having a lower surface that faces the rear substrate, the lower surface of said front substrate comprising a plurality of concave surfaces facing downward towards said rear substrate, said concave surfaces being formed in pairs that face each other, wherein edges of said concave surfaces are arranged adjacent to the partitions;

a first and a second sustaining electrodes arranged on the concave surfaces of the lower surface of the front substrate;

a third dielectric layer arranged over the lower surface of the front substrate to cover the first and the second sustaining electrodes, the lower surface of said front substrate further comprises a plurality of trenches running parallel to the concave surfaces and running between adjacent discharge cells; and a black matrix material arranged in the plurality of trenches.

* * * * *